US011377291B2

(12) United States Patent
Joulia

(10) Patent No.: US 11,377,291 B2
(45) Date of Patent: Jul. 5, 2022

(54) DEVICE FOR PROTECTING AND DISPENSING PASTY OR CREAMY PRODUCTS

(71) Applicant: Pierre Joulia, Talloires-Montmin (FR)

(72) Inventor: Pierre Joulia, Talloires-Montmin (FR)

( * ) Notice: Subject to any disclaimer, the term of this patent is extended or adjusted under 35 U.S.C. 154(b) by 239 days.

(21) Appl. No.: 16/473,912

(22) PCT Filed: Dec. 15, 2017

(86) PCT No.: PCT/FR2017/000244
§ 371 (c)(1),
(2) Date: Jun. 26, 2019

(87) PCT Pub. No.: WO2018/122473
PCT Pub. Date: Jul. 5, 2018

(65) Prior Publication Data

US 2019/0344952 A1 Nov. 14, 2019

(30) Foreign Application Priority Data

Dec. 26, 2016 (FR) ..... 1601861

(51) Int. Cl.
*B65D 83/00* (2006.01)

(52) U.S. Cl.
CPC ..... *B65D 83/0022* (2013.01); *B65D 83/0033* (2013.01); *A45D 2200/051* (2013.01); *B65D 83/0094* (2013.01)

(58) Field of Classification Search
CPC ... B05B 11/00412; B65D 35/56; B65D 77/06; B65D 81/3233; B65D 83/0055;
(Continued)

(56) References Cited

U.S. PATENT DOCUMENTS 2,356,874 A 8/1944 Nageotte
3,361,305 A 1/1968 Spatz
(Continued)

FOREIGN PATENT DOCUMENTS

GB 2 221 957 B 2/1990

OTHER PUBLICATIONS

International Search Report (with English translation) dated Mar. 15, 2018 for International application No. PCT/FR2017/000244.
(Continued)

*Primary Examiner* — Vishal Pancholi
*Assistant Examiner* — Robert K Nichols, II
(74) *Attorney, Agent, or Firm* — Fay Sharpe LLP

(57) ABSTRACT

A sealed device (1) for protecting and dispensing pasty or creamy products (7), includes a reservoir (2) containing the product (7) and suitable for receiving, at the bottom end thereof, a longitudinally movable sealing plug (3). The reservoir (2) is longitudinally movable like a piston in a pump body (4) and it is forced into the closed position by a spring element (5) that cooperates in compression with a lateral outer projection (2*e*) of the reservoir (2) and with the top of the side wall (6*b*) of the base (6) attached to the pump body (4). The pump body (4) includes an elastically deformable upper membrane (4*a*) providing a pump function and also includes, on an upper lateral wall thereof (4*c*), a lateral opening (4*e*) for dispensing the product (7). The assembled reservoir (2) and pump body (4) form a system suitable for circulating the product (7) via a compression chamber (C) supplied from the reservoir (2) by at least one upper inlet orifice (2*b*). The device is particularly suitable for the hygiene, pharmacy and cosmetics fields.

8 Claims, 5 Drawing Sheets

(58) Field of Classification Search
CPC ..... B65D 83/0022; B65D 83/0033; B65D 83/0094; A45D 2200/051
USPC ..... 222/207, 209, 212, 213, 387, 501, 256, 222/105, 106, 327, 389, 326, 386
See application file for complete search history.

(56) References Cited

U.S. PATENT DOCUMENTS

| | | | | |
|---|---|---|---|---|
| 4,479,592 | A | 10/1984 | Rusing et al. | |
| 4,778,084 | A * | 10/1988 | Chen | B65D 83/0022 222/181.2 |
| 5,000,355 | A | 3/1991 | Pritchard | |
| 6,234,360 | B1 * | 5/2001 | Bockmann | B65D 83/0033 222/327 |

OTHER PUBLICATIONS

Written Opinion (with English translation) dated Mar. 15, 2018 for International application No. PCT/FR2017/000244.
International Preliminary Report on Patentability (with English translation) dated Jul. 2, 2019 for International Application No. PCT/FR2017/000244.

* cited by examiner

Coupe A-A

Détail A

DEVICE FOR PROTECTING AND DISPENSING PASTY OR CREAMY PRODUCTS

CROSS-REFERENCE TO RELATED APPLICATION

This application is the U.S. National Phase of PCT International Application No. PCT/FR2017/000244 filed Dec. 15, 2017, which claims priority from French Application No. 1601861 filed Dec. 26, 2016.

FIELD OF INVENTION

The present invention relates to a device for protecting and dispensing pasty or creamy products such as cosmetic creams, toothpastes, creams and shaving gels as well as any other product of similar consistency, particularly simple and economical to achieve and which guarantees a perfect protection to the product to be distributed especially as the product is extracted out due to the total absence of external roughness.

BACKGROUND

We already are familiar with devices for protection and distribution of pasty or creamy products such as, for example, the flexible tubes of toothpaste or sunscreen that just deform by crushing to extract the product to be distributed.

This type of device has the major disadvantage of allowing air to enter the tube when it is dispensed, hence the need to incorporate preservatives or antioxidants in the formula of the product to be dispensed in order to protect it from oxidation due to contact with air. These devices are simply protected from a completely removable plug with the risk of dropping the latter during handling or dirtying or losing it.

We also know devices that keep pasty or creamy products away from the air, including cosmetic pastes and creams and thus protect them from oxidation.

This type of device usually includes: a reservoir intended to contain and to protect from the air the product to be dispensed, in which a plug circulates by depression such as a piston ensuring the airtightness of the product, said reservoir being sealed with a subassembly pump for dispensing the pasty or creamy product. The product is dispensed by a lateral cavity such as a nozzle, exerting pressure on the top of the pump subassembly.

Some devices provide a reservoir consisting of a flexible bag containing the product to be dispensed assembled with a subassembly pump. The volume of the flexible bag adapts by depression at each use according to the remaining volume of product to be distributed. A protective container necessarily dresses the flexible pouch.

Existing devices that have a pump subassembly integral with the reservoir have the disadvantage of being complex, expensive and bulky, indeed, the pump subassembly consists of many components of various materials such as plastics but also of metal such as the springs and balls for sealing the output of the product to be dispensed. These devices have a great complexity of design especially with regard to the sealed valves of the product outlet, and require very significant manufacturing implementation investments. The recycling of materials is expensive and sometimes impossible due to the complexity of dismantling the device.

SUMMARY OF THE INVENTION

The present invention aims to provide a device for protecting and dispensing pasty or creamy products or as a gel, a new design, very economical and whose simplicity of design offers great ease of development, high reliability of operation and makes it possible to obtain very compact dimensions, thus minimizing the weight of the materials used, the cost of materials and the cost of transport.

The device is advantageously recyclable, with a basic design easily removable or mono material versions such as polypropylenes, polyethylenes or others that allow recycling without dismantling.

The small number of components advantageously assembled in line longitudinally as well as the design of each component offer a real financial advantage on the cost of implementation of manufacturing, assembly machine and tools. The realization of the pump body for example with the absence of external undercut requires only a mold of very basic design.

The device, very advantageously by its design, does not have an outlet valve for the product to be dispensed and thus offers a total absence of external cavity avoiding any risk of contamination of any residues of products to be dispensed after use of the device.

The device for protecting and dispensing pasty or creamy product is characterized in that it consists mainly of a reservoir containing the product to be dispensed and adapted to receive at its lower end a longitudinally movable sealing plug, said reservoir is movable longitudinally as a piston and according to a pathway in a pump body and in which it is constrained in the closed position by a spring element which cooperates in compression with a lateral external projection of the reservoir and with the top of the side wall of the bottom which is integral with the pump body by at least one outer projection complementary to an inner and lower groove of the pump body.

The pump body is formed of an elastically deformable upper membrane providing a pump function and, on its upper side wall, a lateral distribution opening of the pasty or creamy product.

The assembled reservoir and pump body form means suitable for the circulation of the product to be dispensed by a compression chamber fed by at least one upper inlet of the reservoir located on the upper closing wall of the reservoir which collaborates with the inner closing face of the pump body.

For use of the device, the dispensing of the product through the lateral opening of the pump body is ensured when a pumping pressure is exerted on the elastically deformable upper membrane of the pump body, said pressure transmitted on the product to be dispensed contained in the compression chamber forces the reservoir to move longitudinally in the pump body following a path, thus partially releasing the lateral opening of the pump body through which the product is dispensed and when the pumping pressure disappears and that the reservoir, constrained by the spring element, closes tightly on the pump body through the upper closure wall of the reservoir which collaborates with the inner closing face of the pump body, the pasty or creamy product to be distributed is again sucked by the upper inlet of the reservoir to fill the compression chamber under the effect of the depression created by the upper diaphragm of the pump body which resumes its initial form of rest.

In an advantageous version of protection, the device ensures a lack of external cavities between the pump body and the reservoir in which residues of the products to be distributed could be housed, for this purpose the reservoir is formed on its upper lateral wall with an outer projection complementary to the lateral distribution opening of the pump body which ensures a closure absent of any external cavity.

In a variant that makes it possible to adapt to the demand of suppliers of dispensing products, the reservoir open at its lower end is adapted to receive a sealed and flexible pouch containing the pasty or creamy product, the volume of the bag adapts by depression to the remaining volume of the product to be dispensed which is discharged through the upper inlet of the reservoir.

In a first variant of the spring function of the device, the bottom incorporates a spring function by at least one elastic spring formed on its horizontal wall and which collaborates with the underside of the side wall of the reservoir.

In a second variant of the spring function of the device, the reservoir incorporates a spring function by at least one resilient tab formed on the side wall and secured to a lower ring formed of an external lateral projection which collaborates with the lower and inner groove of the pump body so as to secure the ring of the reservoir with the pump body.

In a variant reserved more to low-capacity devices, the reservoir is closed on its upper wall which can be manipulated by the elastically deformable upper membrane of the pump body. The reservoir has a lateral product-side flow-through orifice, located above the outer projection, the lateral circulation port being tightly protected by the upper side wall of the pump body in the closed position. The bottom has on its horizontal bottom wall a longitudinal notched projection which collaborates with a longitudinal notched projection of the movable cap by at least one flat face complementary to a flat face belonging to the notched projection of the bottom, so that when the elastically deformable upper membrane of the pump body is subjected to a pumping pressure, the reservoir moves longitudinally in the pump body while the movable cap, constrained by the flat faces of said movable cap and the bottom which immobilize it relative to the bottom, moves in the reservoir. By compression, the pasty or creamy product is dispensed through the lateral orifice of the reservoir when the latter, at least partially cleared from the upper side wall of the pump body due to the necessary operating clearance between the planar faces of the notched projections of the movable cap and the bottom, is in front of the lateral distribution opening of the pump body.

When the pumping pressure disappears, the reservoir constrained by the elastic tab of the bottom closes tightly on the pump body with the lateral orifice of the reservoir which is protected by the upper side wall of the pump body and the movable cap of the reservoir is driven by the pump body by the sufficient clamping between the reservoir and the movable cap necessary for sealing.

According to a more basic variant of realization, the upper wall of the reservoir is accessible through an upper orifice of the pump body so that when the upper wall of the reservoir is directly subjected to a pumping pressure, the reservoir moves longitudinally in the pump body.

The product to be dispensed in the reservoir is packaged through the upper orifice of the reservoir after the assembly of the mobile cap in the reservoir, said movable cap moves longitudinally by depression inside the reservoir ensuring the air and water tightness of the product to be dispensed.

In a variant, the packaging is performed by the open bottom end of the reservoir before the assembly of the movable cap.

BRIEF DESCRIPTION OF THE DRAWINGS

Other features and advantages of the invention will become apparent from the description which follows with reference to the accompanying drawings which are given by way of non-limiting examples.

DETAILED DESCRIPTION OF THE INVENTION

Figure 1:
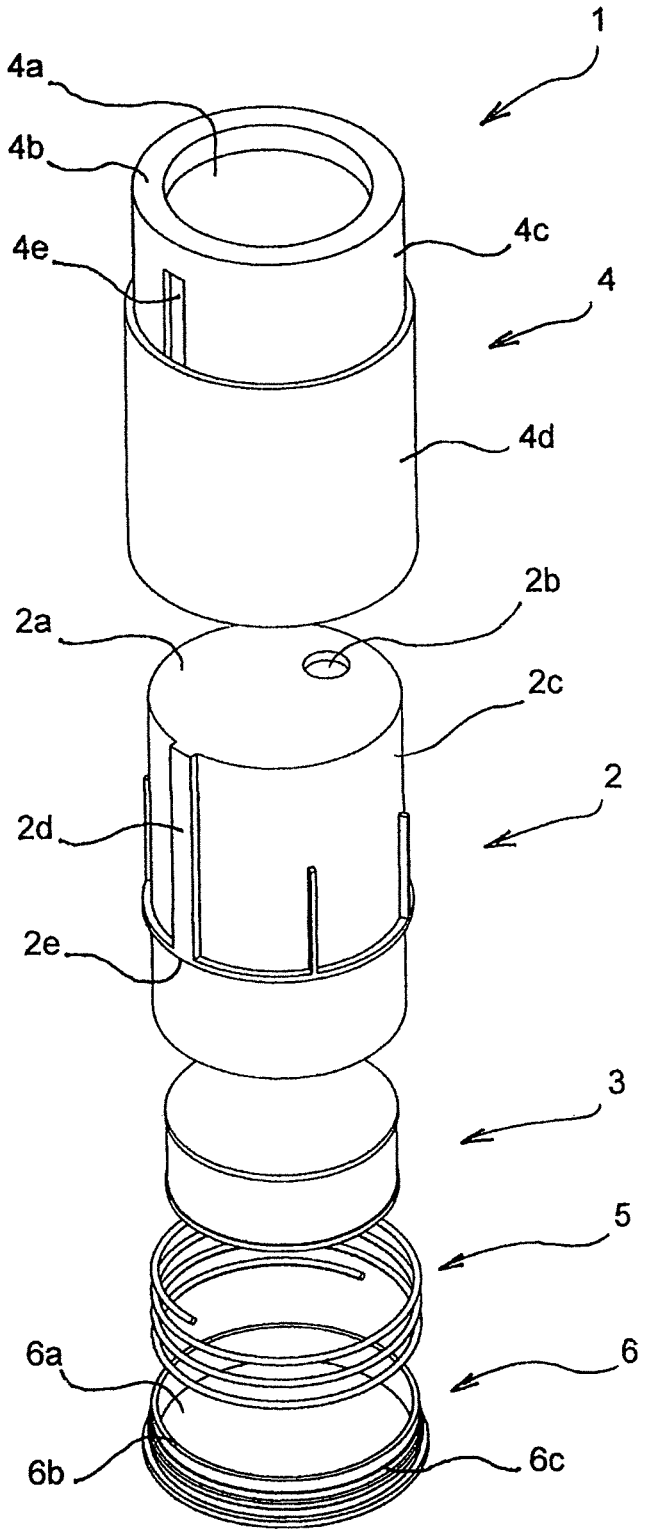
FIG. 1 shows an overall view of the device.
Figure 3:
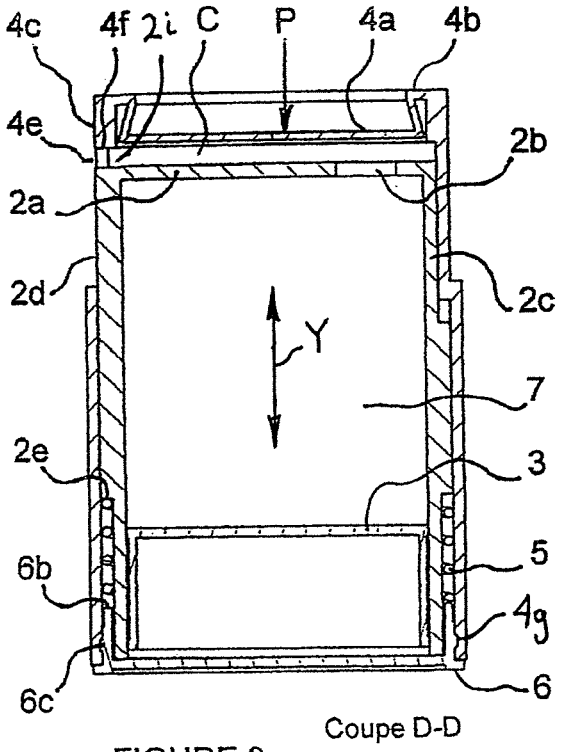
FIGS. 2 and 3 show a front view and a DD section of the device in operation under the effect of a pressure (P).
Figure 2:
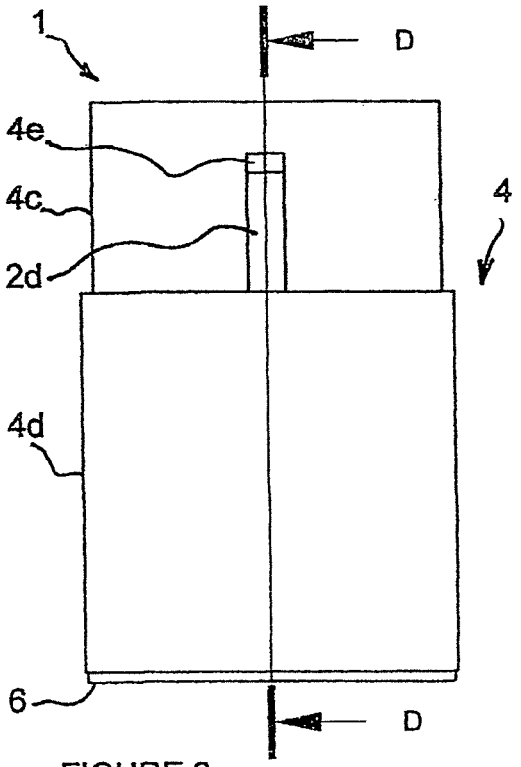
Figure 5:
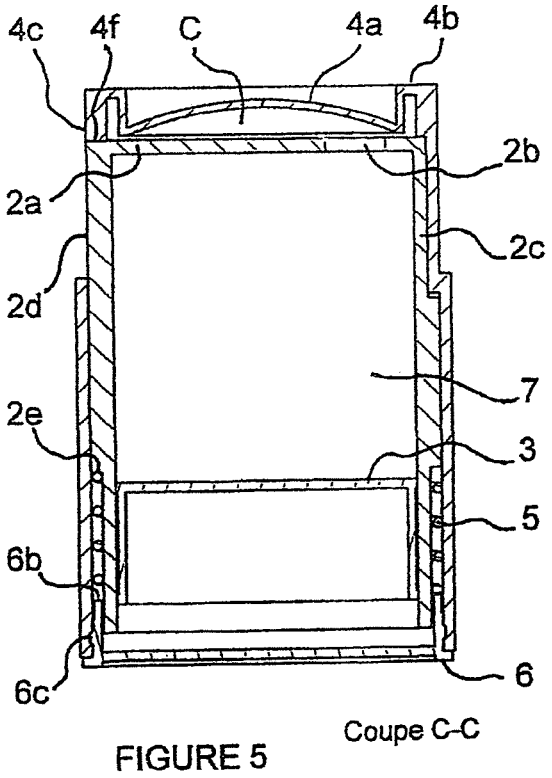
FIGS. 4 and 5 show a front view and a CC section of the device in the closed position to the suppression of the pressure (P).
Figure 4:
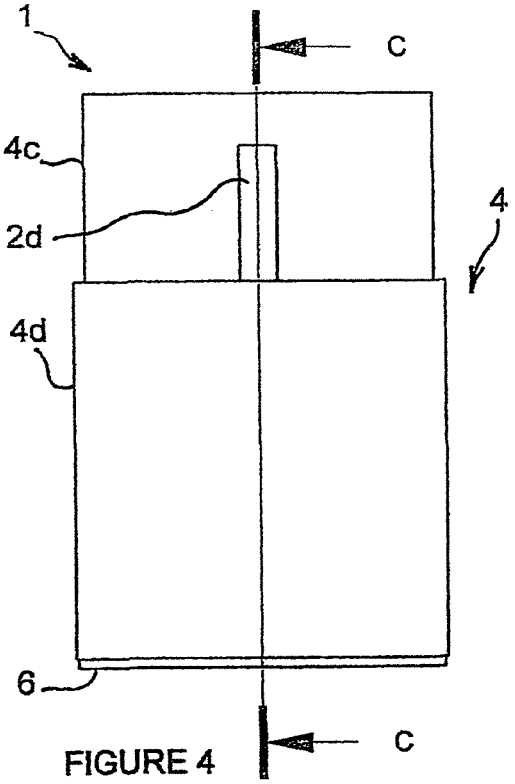
Figure 7:
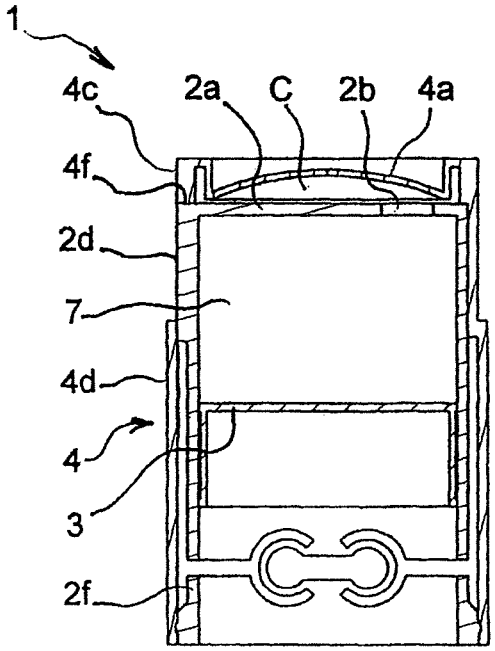
FIGS. 6 and 7 show a top view and an AA section of the device according to a variant of the reservoir incorporating the spring function.
Figure 9:
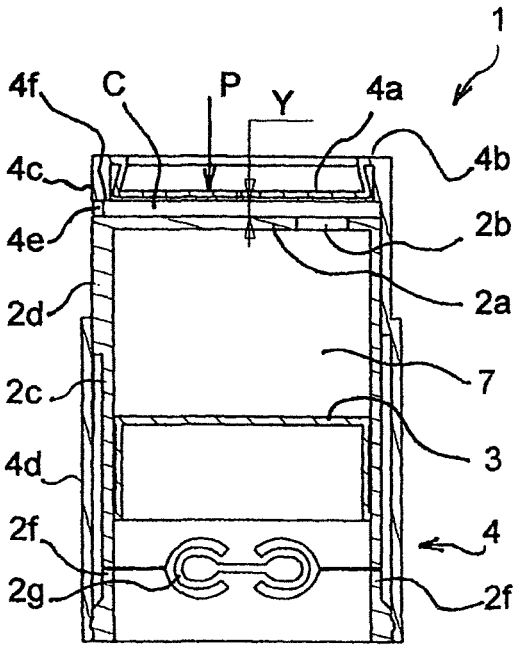
FIGS. 8 and 9 show a top view and an AA section of the device in operation according to the variant of FIGS. 6 and 7.
Figure 6:
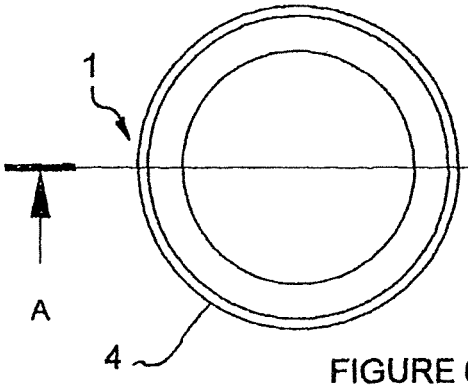
Figure 8:
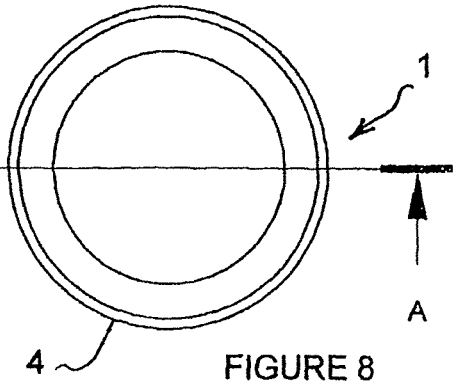
Figure 10:
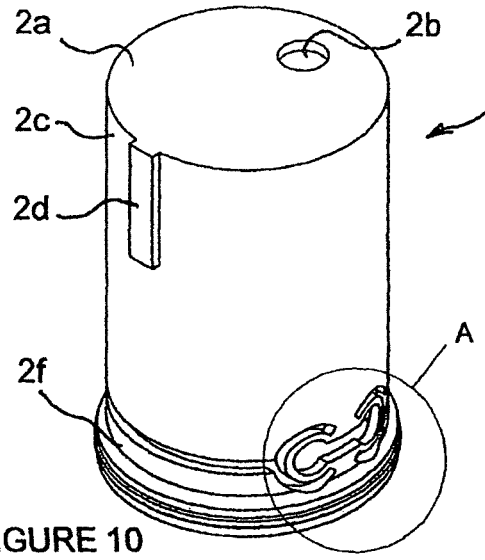
FIG. 10 represents the reservoir in perspective according to FIG. 7.
Figure 11:
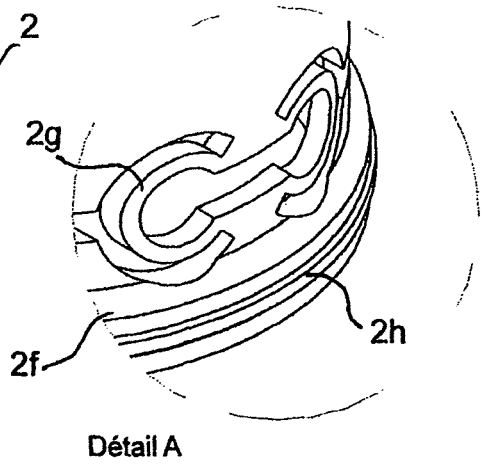
FIG. 11 shows a detail A of FIG. 10.
Figure 14:
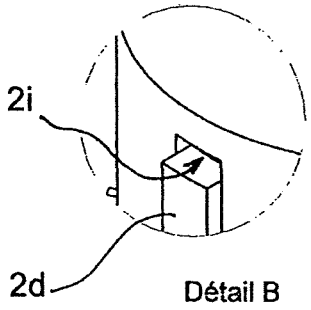
FIG. 14 shows a detail A of FIG. 12.
Figure 13:
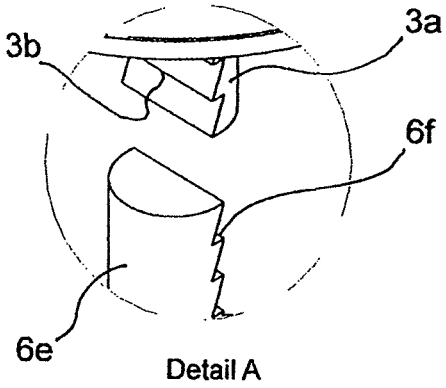
FIG. 13 shows a detail A of FIG. 12.
Figure 12:
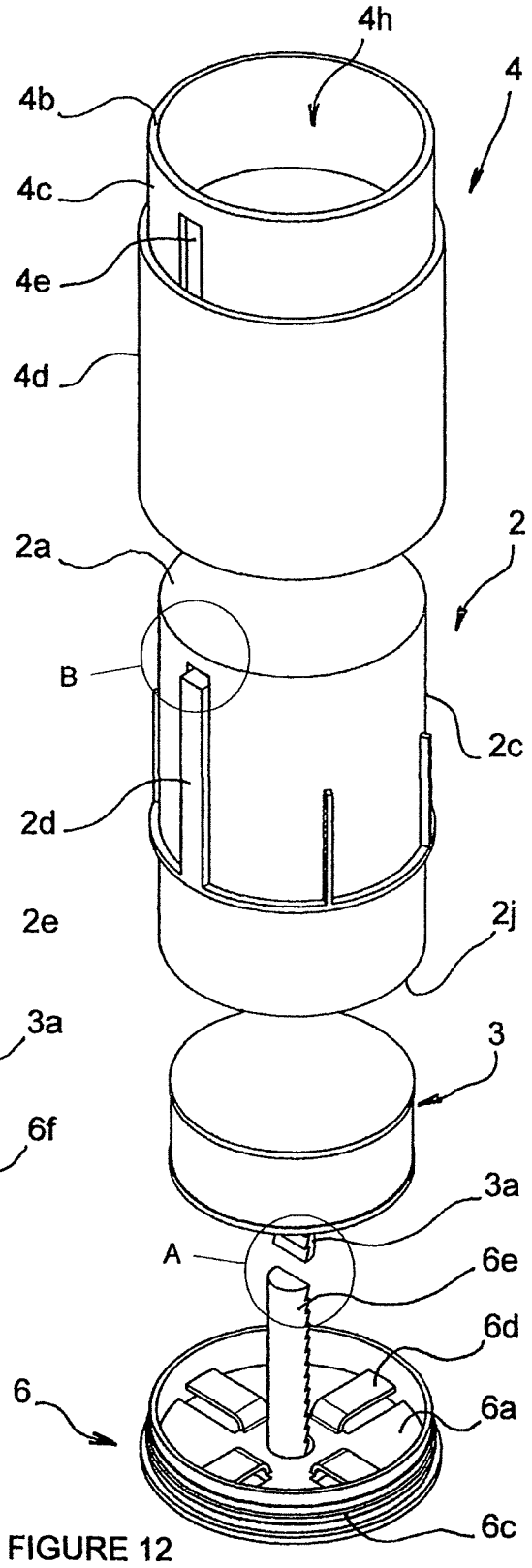
FIG. 12 represents an overall view of the device with the bottom integrating the spring element, in the rest position and in the compression position.
Figure 16:
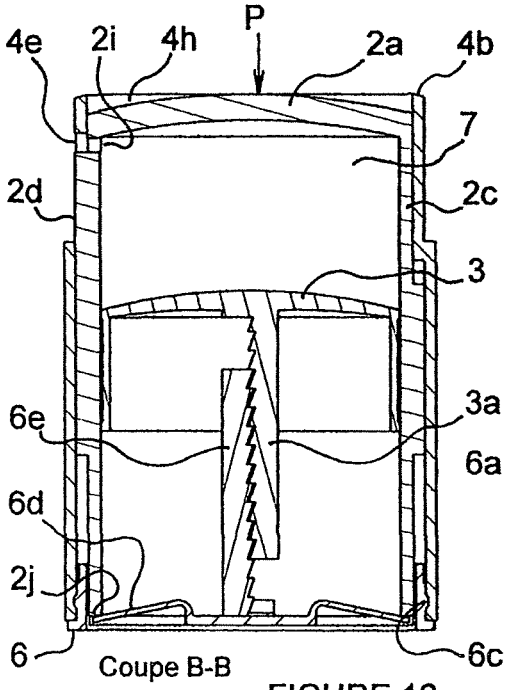
FIGS. 15 and 16 show a front view and a BB section of the device in operation under the effect of a pressure (P) according to FIG. 12.
Figure 15:
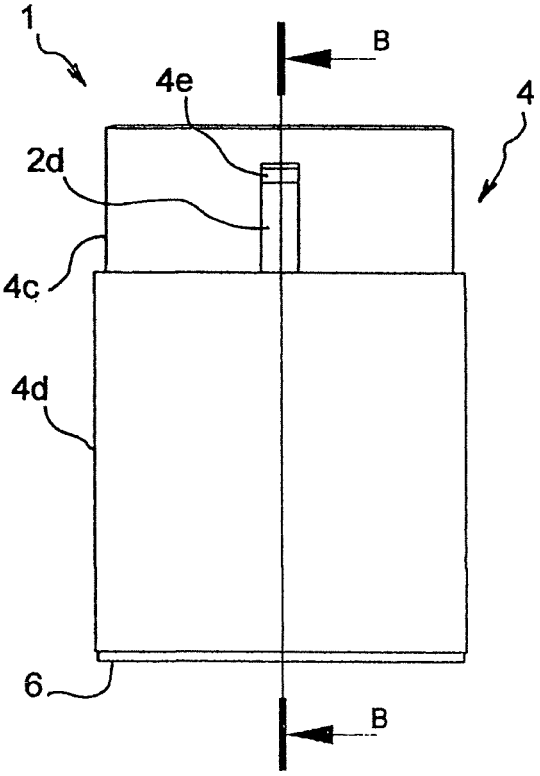
Figure 19:
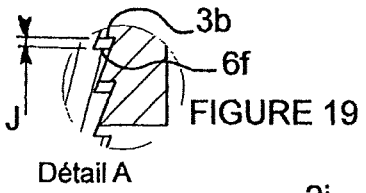
FIG. 19 shows a detail A of FIG. 18.
Figure 18:
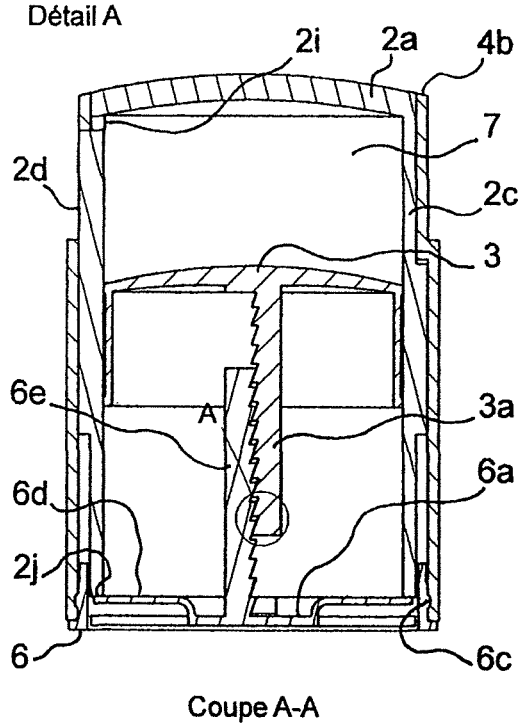
FIGS. 17 and 18 show a front view as well as a section AA of the device in the closed position at the suppression of the pressure (P) according to FIG. 12.
Figure 17:
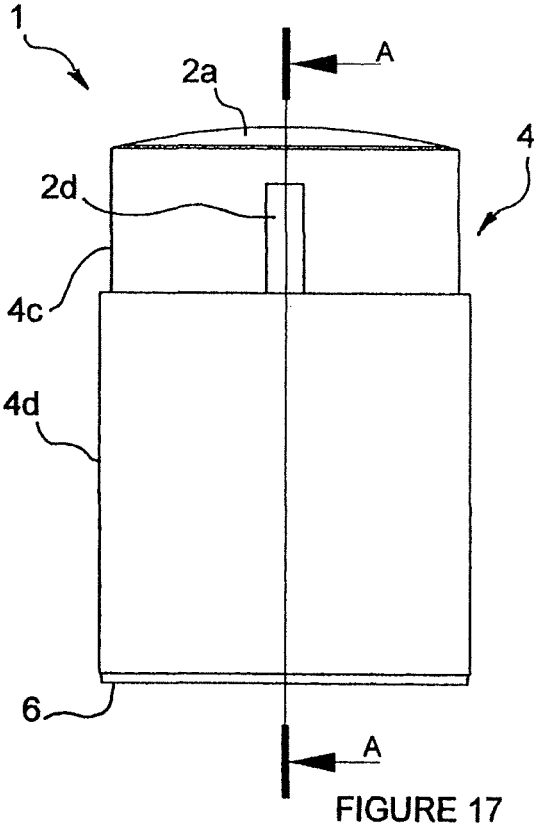

The device (1) for protecting and dispensing pasty or creamy products (7) is characterized in that it consists mainly of a reservoir (2) containing the product (7) and adapted to receive at its lower end a sealing plug (3) movable longitudinally, said reservoir (2) is longitudinally displaceable such as a piston and in or along the path (Y) in a pump body (4) and in which it is constrained in the closed position by a spring element (5) which cooperates in compression with a lateral external projection (2*e*) of the reservoir (2) and with the top of the side wall (6*b*) of the bottom (6) secured to the pump body (4) by at least one outer projection (6*c*) complementary to an inner and lower groove (4*g*) of the pump body (4).

The pump body (4) is formed of an elastically deformable upper membrane (4*a*) providing a pump function and, on its upper side wall (4*c*), a lateral opening (4*e*) for dispensing the product (7).

The reservoir (2) and the pump body assembled (4) form means suitable for the circulation of the product (7) by a compression chamber (C) supplied by at least one upper inlet orifice (2*b*) situated on the upper closure wall (2*a*) of the reservoir (2) which collaborates with the inner closure face (4*f*).

For use of the device (1), the distribution of the product (7) through the opening (4*e*) is ensured when a pressure (P) pumping is exerted on the upper membrane (4*a*), said pressure transmitted on the product (7) contained in the compression chamber (C) forces the reservoir (2) to move longitudinally in the pump body (4) in or along a path (Y), thus partially releasing the opening (4*e*) through which the product (7) is dispensed. When the pressure (P) disappears and the reservoir (2) constrained by the spring element (5) closes tightly on the pump body (4) with the upper closure wall (2*a*) which collaborates with the face inside closure (4*f*), the product (7) is again sucked through the orifice (2*b*) to fill the compression chamber (C) under the effect of the depression created by the upper membrane (4*a*) which returns to its original shape.

In an advantageous version of protection, the device (1) ensures a lack of external cavities between the pump body (4) and the reservoir (2) in which residues of the products (7) to be distributed could be housed, for this purpose the reservoir (2) is formed on its upper lateral wall (2*c*) with an external projection (2*d*) complementary to the lateral opening (4*e*) of distribution of the pump body (4) which ensures a closure which is absent from any outer cavity.

In a variant that makes it possible to adapt to the demand of suppliers for dispensing products, the reservoir (2) open at its lower end is adapted to receive integrally a sealed and flexible pouch containing the product (7), the volume of the bag adapts by depression to the remaining volume of the product (7) which is evacuated through the upper orifice (2*b*).

In a first variant of the spring function of the device (1) for protecting and dispensing pasty or creamy products (7), the bottom (6) integrates a spring function by at least one elastic tab (6*d*) formed on the wall (6*a*) and which collaborates with the lower face (2*j*) of the reservoir (2).

In a second variant of the spring function of the device (1), the reservoir incorporates a spring function by at least one resilient tab formed on the side wall and secured to a lower ring formed of an external lateral projection which collaborates with the lower and inner groove of the pump body so as to secure the ring of the reservoir with the pump body.

In a variant reserved more to low-capacity devices (1), the reservoir (2) is closed on its upper wall (2*a*) which can be manipulated by the elastically deformable upper membrane (4*a*) of the pump body (4). The reservoir (2) has a lateral product-side flow-through orifice (2*i*), located above the outer projection (2*d*), the lateral circulation port (2*i*) being tightly protected by the upper side wall (4*c*) of the pump body (4) in the closed position. The bottom (6) has on its horizontal bottom wall (6*a*) a longitudinal notched projection (6*e*) which collaborates with a longitudinal notched projection (3*a*) of the movable cap (3) by at least one flat face (3*b*) complementary to a flat face (6*f*) belonging to the notched projection (6*e*) of the bottom (6), so that when the elastically deformable upper membrane (4*a*) of the pump body (4) is subjected to a pumping pressure (P), the reservoir (2) moves longitudinally in the pump body (4) while the movable cap (3), constrained by the flat faces (3*b*,6*f*) of said movable cap (3) and the bottom (6) which immobilize it relative to the bottom (6), moves in the reservoir (2). By compression, the pasty or creamy product (7) is dispensed through the lateral orifice (2*i*) of the reservoir when the latter, at least partially cleared from the upper side wall (4*c*) of the pump body (4) due to the necessary operating clearance between the planar faces (3*b*,6*f*) of the notched projections (3*a*,6*e*) of the movable cap (3) and the bottom (6), is in front of the lateral distribution opening (4*e*) of the pump body (4).

When the pumping pressure (P) disappears, the reservoir (2) constrained by the elastic tab (6*d*) of the bottom (6) closes tightly on the pump body (4) with the lateral orifice (2*i*) of the reservoir (2) which is protected by the upper side wall (4*c*) of the pump body (4) and the movable cap (3) of the reservoir (2) is driven by the pump body (4) by the sufficient clamping between the reservoir (2) and the movable cap (3) necessary for sealing.

According to a more basic variant of realization, the upper wall (2*a*) of the reservoir (2) is accessible through an upper orifice (4*h*) of the pump body (4) so that when the upper wall (2*a*) of the reservoir (2) is directly subjected to a pumping pressure (P), the reservoir (2) moves longitudinally in the pump body (4).

The product (7) to be dispensed is packaged in the reservoir (2) through the upper orifice (2*b*) of the reservoir after the assembly of the mobile cap (3) in the reservoir (2), said movable cap (3) moved longitudinally by depression inside the reservoir (2) ensuring the air and water tightness of the product (7) to be dispensed.

In a variant, the packaging is performed by the open bottom end of the reservoir (2) before the assembly of the movable cap (3).

The invention claimed is:

1. A device (1) for protecting and distributing pasty or creamy products (7), said device comprising a reservoir (2) adapted for containing the product (7) and adapted to receive at a lower end a sealing plug (3) movable longitudinally, said reservoir (2) movable longitudinally as a piston along a path (Y) in a pump body (4), wherein the reservoir is constrained in a closed position by a spring which cooperates between the reservoir (2) and the pump body (4), and wherein the reservoir (2) comprises an outer projection (2*d*) formed on a lateral wall (2*c*) of the reservoir (2) and complementary to a lateral opening (4*e*) in the pump body (4) from which the pasty or creamy product is dispensed, wherein the outer projection provides a closure of the lateral opening (4*e*) that lacks any external cavity.

2. The device (1) for protecting and distributing pasty or creamy products (7) according to claim 1, wherein the reservoir (2) is open at its lower end and is secured to a sealed and flexible pouch containing the pasty or creamy product, the volume of the bag adapts by depression to the remaining volume of the pasty or creamy product which is discharged through the upper orifice (2*b*).

3. The device for protecting and distributing pasty or creamy products (7) according to claim 1, wherein said spring comprises at least one elastic tab (6*d*) formed on a wall (6*a*) of a bottom secured to the pump body (4) and wherein said at least one elastic tab (6*d*) engages a lower face (2*j*) of said reservoir (2).

4. The device for protecting and distributing pasty or creamy products (7) according to claim 1, wherein said spring comprises at least one elastic tab (2*g*) formed on the lateral wall (2*c*) of the reservoir (2) and secured to a lower ring (20 of the reservoir (2) that includes an outer lateral projection (2*h*) which collaborates with a groove (4*g*) in the pump body (4) so as to secure the ring (20 to the pump body (4).

5. The device (1) for protecting and distributing pasty or creamy products (7) according to claim 1, wherein the reservoir (2) is closed on an upper wall (2*a*) and wherein the pump body (4) comprises an upper membrane (4*a*) that is manipulated to depress the upper wall (2*a*) of the reservoir (2) to move the reservoir (2) relative to the pump body (4).

6. The device (1) for protecting and distributing pasty or creamy products (7) according to claim 1 wherein an upper wall (2*a*) of the reservoir (2) is accessible through an upper orifice (4*h*) of the pump body (4) so that when the upper wall (2*a*) is directly subjected to a pressure (P), the reservoir (2) moves longitudinally in the pump body (4).

7. A device for distributing an associated creamy product, said device comprising:

a reservoir adapted for containing the associated creamy product;

a sealing plug received in a lower end of the reservoir;

a pump body in which said reservoir is movable longitudinally as a piston;

a spring operably engaged between the pump body and the reservoir that urges said reservoir toward a closed position;

said pump body comprising an elastically deformable upper membrane and said reservoir comprising an upper closure wall, wherein a chamber is defined between the upper closure wall and the elastically deformable membrane;

said upper closure wall of the reservoir comprising an orifice in communication between the reservoir and the chamber for supplying the associated creamy product from the reservoir into the chamber;

said pump body further including a lateral opening in communication with the chamber, wherein the associated creamy product is dispensed from the chamber through the lateral opening when pressure is exerted on the elastically deformable membrane in a direction toward the upper closure wall of the reservoir.

8. A device (1) for protecting and distributing pasty or creamy products (7), said device comprising a reservoir (2) adapted for containing the product (7) and adapted to receive at a lower end a sealing plug (3) movable longitudinally, said reservoir (2) movable longitudinally as a piston along a path (Y) in a pump body (4), wherein the reservoir is constrained in a closed position by a spring which cooperates between the reservoir (2) and the pump body (4), wherein the spring is operably located between and cooperates in compression between a lateral external projection (2*e*) of the reservoir (2) and a top of a side wall (6*b*) of a bottom (6) secured to the pump body (4), wherein the bottom (6) comprises at least one outer projection (6*c*) that is complementary to and received in an inner groove (4*g*) of the pump body (4) whereby the bottom (6) is secured to the pump body (4).

* * * * *